US009128394B2

(12) United States Patent
Hara et al.

(10) Patent No.: US 9,128,394 B2
(45) Date of Patent: Sep. 8, 2015

(54) ELECTROPHOTOGRAPHIC TONER AND METHOD FOR PRODUCING THE SAME

(71) Applicant: TOSHIBA TEC KABUSHIKI KAISHA, Shinagawa-ku, Tokyo (JP)

(72) Inventors: Takafumi Hara, Shizuoka-ken (JP); Masahiro Ikuta, Shizuoka-ken (JP); Tsuyoshi Itou, Shizuoka-ken (JP); Motonari Udo, Shizuoka-ken (JP); Kazuhisa Takeda, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/664,704

(22) Filed: Oct. 31, 2012

(65) Prior Publication Data

US 2013/0137031 A1 May 30, 2013

Related U.S. Application Data

(60) Provisional application No. 61/564,087, filed on Nov. 28, 2011.

(51) Int. Cl.
*G03G 9/00* (2006.01)
*G03G 9/08* (2006.01)
(Continued)

(52) U.S. Cl.
CPC ..... *G03G 9/0804* (2013.01); *G03G 9/0819* (2013.01); *G03G 9/08782* (2013.01); *G03G 9/09* (2013.01); *G03G 9/0926* (2013.01); *G03G 9/0928* (2013.01)

(58) Field of Classification Search
CPC ... G03G 9/00; G03G 9/0802; G03G 9/08755; G03G 9/08782
USPC ..... 430/137.1, 134.14, 137.12, 108.8, 430/110.2, 13.14, 110.27
See application file for complete search history.

(56) References Cited

U.S. PATENT DOCUMENTS 4,961,088 A 10/1990 Gilliland et al.
8,252,496 B2 8/2012 Kabai et al.
(Continued)

FOREIGN PATENT DOCUMENTS

JP 11-327201 11/1999
JP 2005-141144 6/2005
(Continued)

OTHER PUBLICATIONS

Non-Final Office Action for U.S. Appl. No. 14/208,433 Dated Jun. 23, 2014, 22 pgs.
(Continued)

*Primary Examiner* — Thorl Chea
(74) *Attorney, Agent, or Firm* — Amin, Turocy & Watson, LLP

(57) ABSTRACT

An electrophotographic toner produced by mixing a dispersion of colorant particles containing a colorant and a dispersion of release agent particles containing a release agent and having a volume average particle diameter smaller than that of the colorant particles, aggregating the colorant particles and the release agent particles in the dispersion to produce first aggregates, mixing a dispersion of resin particles containing a binder resin and having a volume average particle diameter smaller than that of the release agent particles in the dispersion containing the first aggregates, and aggregating the first aggregates and the resin particles in the dispersion of the first aggregates and the resin particles to coat the first aggregates with the resin particles, producing second aggregates.

5 Claims, 2 Drawing Sheets

(51) Int. Cl.
*G03G 9/09* (2006.01)
*G03G 9/087* (2006.01)

(56) References Cited

U.S. PATENT DOCUMENTS

| | | | | |
|---|---|---|---|---|
| 2005/0100809 | A1 | 5/2005 | Fujino et al. | |
| 2009/0155700 | A1 | 6/2009 | Pang et al. | |
| 2010/0209839 | A1 * | 8/2010 | Kabai et al. | 430/110.2 |
| 2011/0033211 | A1 | 2/2011 | Matsubara et al. | |
| 2011/0165509 | A1 | 7/2011 | Aoki et al. | |
| 2013/0011777 | A1 | 1/2013 | Aoki et al. | |

FOREIGN PATENT DOCUMENTS

| | | |
|---|---|---|
| JP | 2007-248533 | 9/2007 |
| JP | 2009-145885 | 7/2009 |
| JP | 2011-138132 | 7/2011 |
| JP | 2013-019971 | 1/2013 |

OTHER PUBLICATIONS

Office Action of Notification of Reason(s) for Refusal for Japanese Patent Application No. 2012-243846 Dated Sep. 9, 2014, 3 pages.
Final Office Action for U.S. Appl. No. 13/803,922 Dated Jan. 8, 2015, 13 pages.
Final Office Action for U.S. Appl. No. 14/208,433 dated Nov. 28, 2014, 17 pages.
Non-Final Office Action for U.S. Appl. No. 13/803,922 Dated Jul. 31, 2014, 17 pages.
Non-Final Office Action dated Jun. 18, 2015 corresponding to U.S. Appl. No. 13/803,922, filed Mar. 14, 2013.

* cited by examiner

FIG. 2

| | CHARGE STABILITY | | | | | | | LOW-TEMPERATURE FIXITY(LOWEST TEMPERATURE OF FIXITY) | STORAGE STABILITY | |
|---|---|---|---|---|---|---|---|---|---|---|
| | CHARGE AMOUNT[-q/m] | | | | | | CHARGE RETENTION | | 45℃80% | 50℃80% |
| | 0SHEETS | 2000SHEETS | 4000SHEETS | 6000SHEETS | 8000SHEETS | 10000SHEETS | | | | |
| EXAMPLE1 | 42 | 40 | 41 | 40 | 39 | 40 | 95% | 83℃ | G | G |
| COMPARATIVE EXAMPLE1 | 41 | 35 | 31 | 30 | 28 | 27 | 66% | 83℃ | NG | NG |
| EXAMPLE2 | 38 | 38 | 37 | 38 | 36 | 37 | 97% | 83℃ | G | G |
| COMPARATIVE EXAMPLE2 | 39 | 32 | 29 | 27 | 28 | 26 | 67% | 83℃ | G | NG |
| EXAMPLE3 | 42 | 40 | 41 | 40 | 39 | 40 | 95% | 81℃ | G | G |
| COMPARATIVE EXAMPLE3 | 41 | 35 | 31 | 30 | 28 | 27 | 66% | 85℃ | NG | NG |
| EXAMPLE4 | 42 | 40 | 41 | 40 | 39 | 40 | 95% | 79℃ | G | G |
| COMPARATIVE EXAMPLE4 | 41 | 35 | 31 | 30 | 28 | 27 | 66% | 88℃ | NG | NG |
| COMPARATIVE EXAMPLE5 | 41 | 35 | 32 | 30 | 25 | 24 | 59% | 85℃ | NG | NG |
| COMPARATIVE EXAMPLE6 | 42 | 40 | 41 | 40 | 39 | 39 | 93% | 83℃ | G | NG |
| COMPARATIVE EXAMPLE7 | 42 | 32 | 27 | 25 | 26 | 22 | 52% | 83℃ | NG | NG |
| EXAMPLE5 | 42 | 42 | 41 | 40 | 39 | 39 | 93% | 78℃ | G | G |
| EXAMPLE6 | 42 | 41 | 41 | 40 | 39 | 39 | 93% | 75℃ | G | G |
| EXAMPLE7 | 42 | 42 | 41 | 40 | 39 | 39 | 93% | 72℃ | G | G |

ELECTROPHOTOGRAPHIC TONER AND METHOD FOR PRODUCING THE SAME

CROSS-REFERENCE TO RELATED APPLICATION

This application is also based upon and claims the benefit of priority from U.S. provisional application 61/564,087, filed on Nov. 28, 2011; the entire contents of which are incorporated herein by reference.

FIELD

Embodiments described herein relate generally to a technique for an electrophotographic toner.

BACKGROUND

As a method for producing a toner, an aggregation method has been known. The aggregation method is performed as follows. An aggregating agent such as a metal salt is used to purposefully break the dispersion state of particles of toner components including a binder resin, a colorant, and a release agent in a medium such as water. Thus, the particles are aggregated to obtain aggregate particles. The resulting aggregate particles are then heated and fused to obtain a toner. The heating and fusing processes may be performed simultaneously.

In the aggregation method, for example, nano-scale particles can be aggregated to produce a toner. Therefore, the aggregation method can decrease the particle diameter of the toner and alter the shape of the toner depending on heating conditions for fusion. Accordingly, the aggregation method is suitable as the method for producing a toner.

However, among the toner components, particles of a component having hydrophilicity higher than that of a binder resin and particles of a component having a micro-scale particle diameter are likely to be exposed on the surface of the toner in the conventional aggregation method. As a result, the charge property and storage stability of the toner may deteriorate.

In order to prevent the particles from being exposed on the surface of the toner, an encapsulated toner has been proposed. However, the encapsulated toner cannot achieve sufficient effect of suppressing the particles exposed on the surface.

DESCRIPTION OF THE DRAWINGS

FIG. 2 is a table showing measured results of charge stability, low-temperature fixity, and storage stability when each toner in Examples or Comparative Examples is used.

DETAILED DESCRIPTION

Figure 1:
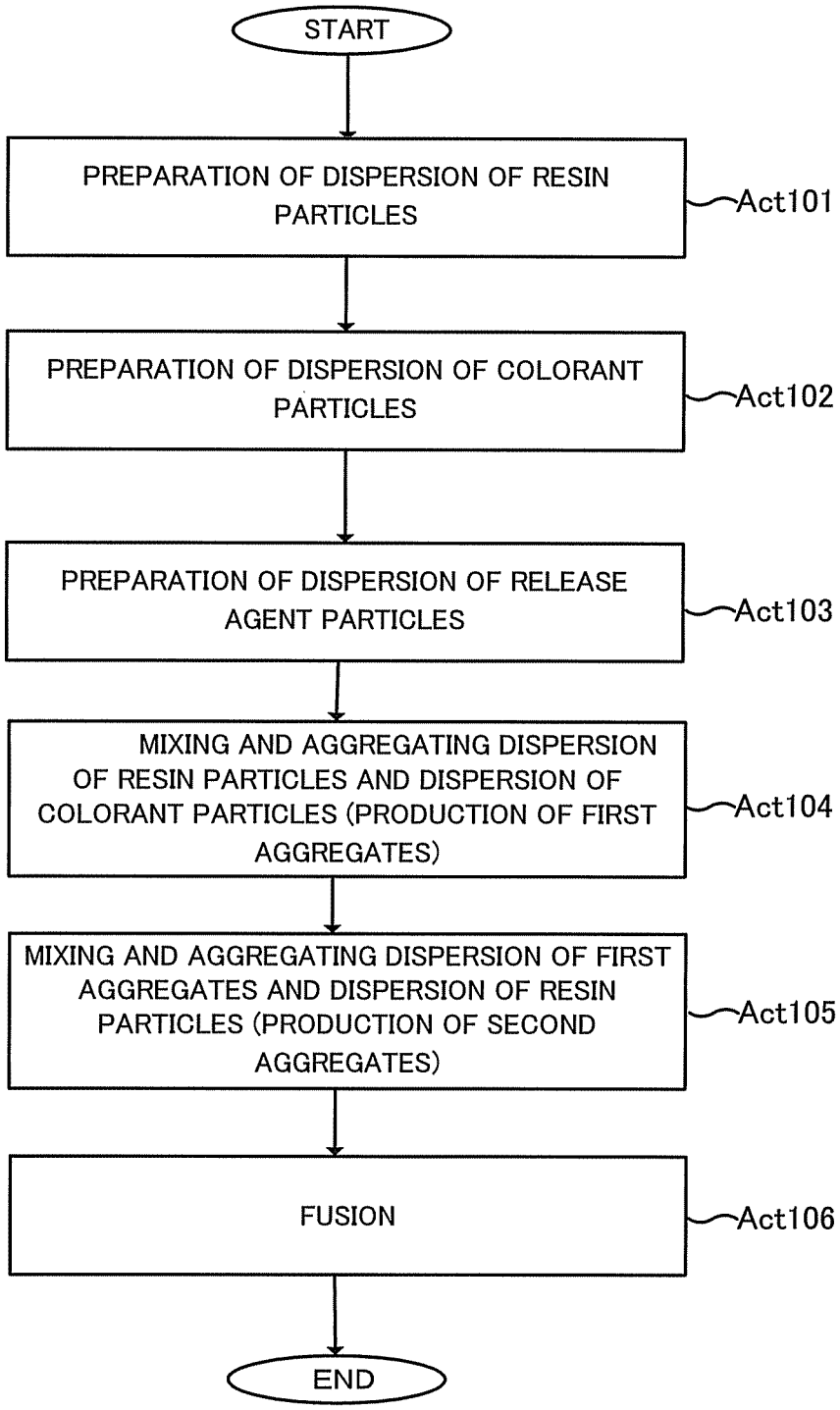
FIG. 1 is a process flow chart illustrating one example of a method for producing an electrophotographic toner of an embodiment.

An electrophotographic toner (hereinafter sometimes simply referred to as a toner) of an embodiment is produced as follows. A dispersion of colorant particles containing a colorant and a dispersion of release agent particles containing a release agent and having a volume average particle diameter smaller than that of the colorant particles are mixed, and the colorant particles and the release agent particles are aggregated in the obtained dispersion to produce first aggregates. A dispersion of resin particles containing a binder resin and having a volume average particle diameter smaller than that of the release agent particles is mixed in the dispersion containing the resulting first aggregates. The first aggregates and the resin particles are aggregated in the dispersion of the first aggregates and the resin particles to coat the first aggregates with the resin particles. Thus, second aggregates are obtained.

Hereinafter, embodiments will be described with reference to the drawings.

The present inventors have found that the conventional aggregation method is unlikely to control the disposition of toner components, and that, for example, particles of a component having hydrophilicity higher than that of a binder resin and particles of a component having a micron-scale particle diameter, including a microencapsulated colorant, are disposed on the surface of aggregates. The particles disposed on the surface of the aggregates are likely to be exposed on the surface of toner due to decreased viscosity of fused binder resin (hereinafter, a state in which the particles of toner components are exposed on the surface of toner is simply referred to as the surface exposure of particles). Further, the toner produced by the conventional aggregation method has a shape in which the density of resin on the surfaces of aggregate particles is insufficient. For this reason, the surface exposure of particles cannot be suppressed.

The inventors have intensively studied, and as a result found that colorant particles and release agent particles having a volume average particle diameter smaller than that of the colorant particles are aggregated, the resulting aggregates (first aggregates) and resin particles having a volume average particle diameter smaller than that of the release agent particles are aggregated to coat the surfaces of the first aggregates with the resin particles, and therefore the surface exposure of particles can be suppressed.

The toner produced by the conventional aggregation method does not have sufficient density of resin on the surfaces of aggregate particles. On the other hand, the toner of the embodiment has the first aggregates coated with the resin particles. That is, the colorant is coated with a layer of the release agent and a layer of the binder resin existing outside the layer of the release agent. As a result, the toner of the embodiment can suppress the surface exposure of particles. Accordingly, the toner has excellent charge stability and storage stability in comparison with the toner produced by the conventional aggregation method.

FIG. 1 is a flow chart illustrating one example of a method for producing the toner of the embodiment.

In Act101 to Act103, a dispersion of resin particles, a dispersion of colorant particles, and a dispersion of release agent particles are prepared. The colorant used herein refers to a compound or a composition which imparts a color to a toner.

The preparation of dispersions of each particle is not particularly limited, and can be appropriately selected by those skilled in the art. Examples thereof may include an emulsion polymerization method, a mechanical emulsification method, a phase inversion emulsification method, and a melting emulsification method. Further, the surface of each particle produced may be microencapsulated by an interface polymerization method, an in situ polymerization method, a coacervation method, an in-liquid drying method, or an in-liquid curing coating method. As a dispersion medium used in preparation of a dispersion, water, alcohol such as ethanol or glycerol, or a water-soluble organic solvent such as glycol ether may be used.

In the present embodiment, the volume average particle diameter of the release agent particles is smaller than that of the colorant particles, and the volume average particle diameter of the resin particles is smaller than that of the release agent particles.

The volume average particle diameter of the colorant particles in the dispersion of the colorant particles is preferably 0.5 μm to 7 μm, and more preferably 0.7 μm to 5 μm. When it is less than 0.5 μm, the charge stability and storage stability of a toner may be lower than those within the above range. When it is more than 5 μm, the color developability of a toner may be lower than that within the above range.

From the viewpoints of charge stability and storage stability, the volume average particle diameter of the resin particles in the dispersion of the resin particles is preferably 0.01 μm to 1.0 μm, and more preferably 0.05 μm to 0.5 μm.

The volume average particle diameter used herein is a particle diameter of particle in the dispersion which is measured as a volume median diameter (D50) by a laser diffractive scattering method. In the present embodiment, the volume average particle diameter can be measured by SALD7000 manufactured by Shimadzu Corporation.

In an aspect of the embodiment, the dispersion of resin particles, the dispersion of colorant particles, and the dispersion of release agent particles can be prepared in Act101 to Act103. The order of preparation of the dispersions is not particularly limited as long as the preparation of the dispersions is performed until mixing of the dispersions. For example, the preparation of the resin particles performed in Act103 may be done after production of first aggregates.

In Act104, the dispersion of colorant particles and the dispersion of release agent particles are mixed, and the colorant particles and the release agent particles are aggregated in the dispersion of colorant particles and release agent particles to produce first aggregates.

A method for producing the first aggregates is not particularly limited, and examples thereof may include an aggregation method by use of metal salt or adjustment of pH, and a method for mixing colorant particles and release agent particles which each have zeta potentials with different signs to aggregate them. In the first aggregate, release agent particles having a volume average particle diameter smaller than that of colorant particles are disposed outside the colorant particles.

In Act105, a dispersion of resin particles is mixed in the dispersion of the first aggregates obtained in Act104 to aggregate the first aggregates and the resin particles in the dispersion of the first aggregates and the resin particles. Thus, second aggregates are produced. The resin particles have a volume average particle diameter smaller than that of the release agent particles disposed outside the colorant particles in each of the first aggregates. Further, the resin particles are disposed outside the release agent particles. Therefore, the first aggregates are coated with the resin particles.

A method for aggregating the first aggregates and the resin particles is not particularly limited, and examples thereof may include a hetero aggregation method.

In Act106, a surfactant is added if necessary, and fusion is performed by heating to produce toner particles.

When the resulting toner particles are used in a dry-type electrophotographic device, post-treatments such as washing, drying, and externally adding are performed. When the resulting toner particles are used in a wet-type electrophotographic device, drying and the like may not be performed appropriately, and a material for adjustment of dispersion may be added suitably.

The thus produced toner has a release agent layer formed of release agent particles, which is disposed outside the colorant, and a binder resin layer formed of resin particles, which is disposed outside the release agent layer. In the toner of the embodiment, the colorant is coated with the release agent layer and the binder resin layer disposed outside the release agent layer.

Hereinafter, the components of the toner according to the present embodiment will be described. In the present embodiment, an aggregating agent, a surfactant, and a pH adjusting agent may be used during production. They will be described.

The contents of the toner components, the amounts of the aggregating agent, and the like, are not particularly limited, and can be determined properly by those skilled in the art.

Binder Resin

In the present embodiment, a resin contained in the resin particles and capable of being used as a binder is not particularly limited, and examples thereof may include a polyester resin and a styrene resin. Among them, a polyester resin is preferable. A polyester resin has a glass transition temperature lower than that of a styrene resin, and can be used in fixing treatment at lower temperature.

Examples of an acid component in the polyester resin may include aromatic dicarboxylic acid such as terephthalic acid, phthalic acid, and isophthalic acid, aliphatic carboxylic acid such as fumaric acid, maleic acid, succinic acid, adipic acid, sebacic acid, glutaric acid, pimelic acid, oxalic acid, malonic acid, citraconic acid, and itaconic acid. Examples of an alcohol component in the polyester resin may include aliphatic diol such as ethylene glycol, propylene glycol, 1,4-butanediol, 1,3-butanediol, 1,5-pentanediol, 1,6-hexanediol, neopentyl glycol, trimethylene glycol, trimethylolpropane, and pentaerythritol, alicyclic diol such as 1,4-cyclohexanediol and 1,4-cyclohexanedimethaol, and ethylene oxide such as bisphenol A, and propylene oxide adducts.

Further, the components in the polyester resin may be converted so as to have a crosslinking structure using a trivalent or higher, that is, polyvalent carboxylic acid component or a trihydric or higher, that is, polyhydric alcohol component such as 1,2,4-benzenetricarboxylic acid (trimellitic acid) or glycerin.

A mixture of two or more polyester resins having different compositions may be used as the binder resin.

The polyester resin may be crystalline or non-crystalline.

The glass transition temperature of the polyester resin is preferably 40° C. to 70° C., and more preferably 45° C. to 65° C. When the glass transition temperature of the polyester resin is lower than 40° C., the storage stability of the toner is decreased in comparison with a toner having the range of glass transition temperature of the polyester resin. When it is higher than 70° C., the low-temperature fixity of the toner is insufficient in comparison with the toner having the range of glass transition temperature of the polyester resin.

In the present embodiment, the content of the binder resin in the toner is, but not particularly limited to, 20 to 99 parts by mass based on 100 parts by mass of the toner. According to the embodiment, when the content of the binder resin is decreased in comparison with the conventional aggregation method, the charge stability and storage stability can be kept. Therefore, even when the contents of the colorant and release agent are increased with the charge stability and storage stability kept, the color developability and low-temperature fixity of the toner can be improved.

Colorant

Examples of a colorant contained in the colorant particles may include carbon black, and organic or inorganic pigment and dye.

Examples of the carbon black may include acetylene black, furnace black, thermal black, channel black, and ketjen black. Examples of a yellow pigment may include C.I. pigment Yellow 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183, and 185, C.I. Bat Yellow 1, 3, and 20. The yellow pigments may be used alone or as a mixture of two or more thereof. Examples of a magenta pigment may include C.I. pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209, and 238, C.I. pigment Violet 19, C.I. Bat Red 1, 2, 10, 13, 15, 23, 29, and 35. The pigments may be used alone or as a mixture of two or more thereof. Examples of a cyan pigment may include C.I. pigment Blue 2, 3, 15, 16, and 17, C.I. Bat Blue 6, and C.I. acid Blue 45. The pigments may be used alone or as a mixture of two or more thereof.

As the dye, known dyes such as aqueous dyes and oily dyes can be used. From the viewpoints of formation of particles, a toner preferably has a micro-capsule structure.

In the present embodiment, the colorant particles may be configured to contain at least a color developable compound and a color developer as the colorant and have a capsule structure coated with an outer shell. A toner containing a color developable compound and a color developer as a colorant can be used in a decolorizing treatment described below to delete an image formed in a recording medium by an image forming process. Therefore, the toner containing a color developable compound and a color developer as a colorant is a decolorizable toner.

The color developable compound is an electron donating compound which accepts a proton from the color developing agent when coupling. In the present embodiment, the color developable compound is not particularly limited and can be appropriately selected by those skilled in the art. For example, a leuco dye can be used. Examples of the leuco dye may include diphenylmethane phthalides, phenylindolyl phthalides, indolyl phthalides, diphenylmethane azaphthalides, phenylindolyl azaphthalides, fluorans, styrynoquinolines, and diaza-rhodamine lactones.

Specific examples may include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one,2-(diethylamino)-8-(diethylamino)-4-methyl-, spiro[5H-(1)benzopyrano(2,3-d)pyrimidine-5,1'(3'H)isobenzofuran]-3'-one,2-(di-n-butylamino)-8-(di-n-butylamino)-4-methyl-, spiro[5H-(1)benzopyrano(2,3-d)pyrimidine-5,1'(3'H)isobenzofuran]-3'-one,2-di-n-butylamino)-8-(diethylamino)-4-methyl-, spiro[5H-(1)benzopyrano(2,3-d)pyrimidine-5,1'(3'H)isobenzofuran]-3'-one,2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one,2-(di-n-butylamino)-8-(di-n-butylamino)4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. In addition, examples thereof may include pyridine, quinazoline, and bisquinazoline compounds. The compounds may be used by mixing two or more kinds thereof.

The color developer is an electron accepting compound which imparts a proton to the color developable compound such as a leuco dye. Examples of the color developer may include phenols, metal salts of phenols, metal salts of carboxylic acids, aromatic carboxylic acids, aliphatic carboxylic acids having 2 to 5 carbon atoms, benzophenones, sulfonic acids, sulfonate salts, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole and derivatives thereof, which has an alkyl group, an aryl group, an acyl group, an alkoxycarbonyl group, a carboxyl group, esters thereof, an amido group, or a halogen group as a substituent, bisphenols, trisphenoles, phenol-aldehyde condensation resin, and metal salts thereof. The compounds may be used by mixing two or more kinds thereof.

Specific examples of the color developer may include phenol, o-cresol, tertiary butyl catechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acid and esters thereof, such as 2,3-dihydroxybenzoic acid, methyl 3,5-dihydroxybenzoate, resorcinol, gallic acid, dodecyl gallate, ethyl gallate, butyl gallate, propyl gallate, 2,2-bis(4-hydroxyphenyl)propane, 4,4-dihydroxydiphenylsulfone, 1,1-bis(4-hydroxyphenyl)ethane, 2,2-bis(4-hydroxy-3-methylphenyl)propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)n-hexane, 1,1-bis(4-hydroxyphenyl)n-heptane, 1,1-bis(4-hydroxyphenyl)n-octane, 1,1-bis(4-hydroxyphenyl)n-nonane, 1,1-bis(4-hydroxyphenyl)n-decane, 1,1-bis(4-hydroxyphenyl)n-dodecane, 2,2-bis(4-hydroxyphenyl)butane, 2,2-bis(4-hydroxyphenyl)ethyl propionate, 2,2-bis(4-hydroxyphenyl)-4-methylpentane, 2,2-bis(4-hydroxyphenyl)hexafluoropropane, 2,2-bis(4-hydroxyphenyl)n-heptane, 2,2-bis(4-hydroxyphenyl)n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-benzenetriol, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4',4"-ethylidenetrisphenol, 4,4'-(1-methylethylidene)bisphenol, and methylenetris-p-cresol. The compounds may be used by mixing two or more kinds thereof.

In the present embodiment, in addition to the color developable compound and the color developer, the colorant particles may contain a decolorizing agent. The decolorizing agent is a substance which is preferentially compatible with the color developer and thereby has an action of decolorizing by reducing the interaction between the color developable compound and the color developer, and a known substance can be used in the present embodiment. The toner according to the embodiment can be decolorized by heating even if the toner does not contain a decolorizing agent. However, when the toner contains the decolorizing agent, a decolorizing treatment can be more promptly performed.

The content of the colorant in the toner is, but not particularly limited to, 0.5 to 40 parts by mass based on 100 parts by mass of the toner.

Release Agent

Examples of a release agent in the release agent particles may include aliphatic hydrocarbon waxes such as low-molecular weight polyethylenes, low-molecular weight polypropylenes, polyolefin copolymers, polyolefin waxes, paraffin waxes, and Fischer-Tropsch wax and modified substances thereof; vegetable waxes such as carnauba wax, candelilla wax, Japan wax, jojoba wax, and rice wax; animal waxes such as bees wax, lanolin, and spermaceti wax; mineral waxes such as montan waxes, ozokerite, and ceresin; fatty acid amides such as linoleic acid amide, oleic acid amide, and lauric acid amide; functional synthetic waxes, and silicon-based waxes. When polyester resin is used as the binder resin, aliphatic hydrocarbon wax is preferable from the viewpoints of low-temperature fixity and incompatibility.

The content of the release agent in the toner is, but not particularly limited to, 0.5 to 40 parts by mass based on 100 parts by mass of the toner.

Charge Controller

In the present embodiment, other components such as a charge controller may be contained in addition to the binder resin, the colorant, and the release agent in a total content of 100 parts by weight.

As the charge controller, a metal-containing azo compound is used, and a complex and a complex salt of iron, cobalt, or chromium, and a mixture thereof are preferable. A metal-containing salicylic acid derivative compound is also used, and a complex and a complex salt of zirconium, zinc, chromium, or boron, and a mixture thereof are preferable.

A method for adding a charge controller to a toner is not particularly limited. For example, in preparation of a dispersion of resin particles, a charge controller may be mixed in the dispersion.

Aggregating Agent

An aggregating agent used in the present embodiment is not particularly limited. A strong cationic aggregating agent including a monovalent metal salt such as sodium chloride, a polyvalent metal salt such as magnesium sulfate and ammonium sulfate, a nonmetal salt such as ammonium chloride and ammonium sulfate, an acid such as hydrochloric acid and nitric acid, polyamine, or polyDADMAC can be appropriately used.

Surfactant

In the present embodiment, a surfactant can be used if necessary. The surfactant is not particularly limited, and for example anionic surfactants such as sulfate salt-based, sulfonate salt-based, phosphate ester-based, and fatty acid salt-based surfactants; cationic surfactants such as amine salt-based and quaternary ammonium salt-based surfactants; amphoteric surfactants such as betaine; nonionic surfactants such as polyethylene glycol-based, alkylphenol ethylene oxide adduct-based, and polyhydric alcohol-based surfactants; and high-molecular surfactants such as polycarboxylic acid can be appropriately used. In general, a surfactant is added in order to impart stability of dispersion such as stability of aggregated particles. Further, reversed polar surfactants may be used as an aggregating agent.

pH Regulator

In the present embodiment, a pH regulator can be used to control the pH in a system, if necessary. The pH regulator is not particularly limited. A basic compound such as sodium hydroxide, potassium hydroxide, and amine compounds can appropriately be used as alkali. And an acidic compound such as hydrochloric acid, nitric acid, and sulfuric acid can appropriately be used as acid.

When the toner according to this embodiment is used in a dry-type electrophotographic device, the toner is mounted on an image forming apparatus such as a multifunction peripheral (MFP) as a non-magnetic one-component developer or two-component developer, and can be used in the formation of an image on a recording medium. When the toner is used in a two-component developer, a carrier which can be used is not particularly limited and can be appropriately selected by those skilled in the art. When the toner is used in a wet-type electrophotographic device, the toner is mounted on an image forming apparatus as a dispersion in which the toner is dispersed in a carrier liquid, and can be used in the formation of an image on a recording medium in the same manner as in the dry-type electrophotographic device.

In an image formation process, a toner image formed using the toner according to this embodiment transferred onto a recording medium is heated at a fixing temperature, and a resin is melted to penetrate in the recording medium. The resin is then solidified to form an image on the recording medium (fixing treatment).

Further, when the colorant contains a color developable compound and a color developer, an image formed on a recording medium can be decolorized by decolorizing treatment of the toner. Specifically, the decolorizing treatment can be performed as follows. The recording medium having an image formed thereon is heated at a heating temperature equal to or higher than the decolorizing temperature to decouple the coupled color developable compound and color developer from each other.

Hereinafter, the method for producing a toner according to the embodiment will be described in detail by Examples, and the embodiment is not limited to the Examples.

Toners were produced in Examples and Comparative Examples, and the charge stability, low-temperature fixity, and storage stability thereof were evaluated. In the evaluation, a developer was produced by mixing each toner in Examples or Comparative Examples and a ferrite carrier coated with a silicone resin so that the concentration of the toner is 8%.

Evaluation of Charge Stability

A developer produced by using each toner in Examples and Comparative Examples was loaded into MFP e-STUDIO 4520C (manufactured by TOSHIBA TEC CORPORATION), text images were printed on 10,000 sheets of papers at normal temperature and normal humidity. At this time, transition of charge amount (−q/m) every 2,000 sheets of paper was measured. A charge retention (%) was calculated from the charge amounts before and after printing text images on 10,000 sheets of paper. The charge amount was measured by a charge measurement system for powder TYPE TB-203 (manufactured by KYOCERA Chemical Corporation).

Evaluation of Low-Temperature Fixity

MFP e-STUDIO 4520C (manufactured by Toshiba Tec Corporation) was modified so that an image not fixed can be caught. The developer produced by using each toner in Examples and Comparative Examples was placed in the MFP, and a solid image was formed at normal temperature and normal humidity so that the adhesion amount of toner on a sheet of paper with a basis weight of 80 g/m$^2$ was 0.5 mg/cm$^2$. The image was fixed at a sheet feed speed of 30 mm/sec by a fixer modified so that the fixing temperature can be changed, and a lowest fixing temperature capable of being fixed was evaluated.

Evaluation of Storage Stability 20 g of toner in Examples or Comparative Examples was put in an open container, and was allowed to stand for 24 hours in a thermostatic oven at 45° C. and 80% RH or at 50° C. and 80% RH. 24 hours after the standing, the toner was evaluated with respect to the following indexes.

NG: mass was formed or contracted.

G: shape of toner particle was kept.

Production of Dispersion 1 of Resin Particles 30 parts by mass of polyester resin (acid value: 10 mg KOH/g, Mw: 15,000, Tg: 580C), 1 part by mass of sodium dodecyl benzenesulfonate (NEOPELEX G15, available from Kao Corporation), and 69 parts by mass of deionized water were mixed to obtain a dispersion solution, and the pH of the dispersion solution was adjusted to 12 by potassium hydroxide. The dispersion solution was put into a high-pressure homogenizer NANO3000 (manufactured by Beryu Co., Ltd.), and was treated at 150° C. and 150 MPa to obtain a dispersion 1 of resin particles. The volume average particle diameter of the dispersion 1 was measured by SALD7000 (manufactured by Shimadzu Corporation) to be 0.23 μm. The dispersion 1 had a shape particle size distribution with a standard deviation of 0.15.

Production of Dispersion 1 of Colorant Particles 2 parts by mass of 3-(4-diethylamino-2-hexyloxyphenyl)-3-(1-ethyl-2-methylindol-3-yl)4-azaphtalide as a leuco dye, 4 parts by mass of 1,1-bis(4'-hydroxyphenyl)hexafluoropropane and 4 parts by mass of 1,1-bis(4'-hydroxyphenyl)n-decane as color developers, and 50 parts by mass of 4-benzyloxyphenylethyl caprylate as a decolorizing agents were uniformity dissolved by warming. 30 parts by mass of aromatic polyvalent isocyanate prepolymer and parts by mass of ethyl acetate as encapsulating agents were mixed in the obtained mixture to obtain a solution. The solution was dispersed in 300 parts by mass of 8% polyvinyl alcohol solution by emulsification and the mixture was stirred at 70° C. over about 1 hour. After then, 2.5 parts by mass of modified water-soluble aliphatic amine as a reactant was added, and the resulting mixture was stirred over 6 hours to obtain colorless capsule particles. The dispersion of capsule particles was put in a refrigerator (−30° C.) to develop color. Deionized water was added to obtain a 27% by weight dispersion 1 of colorant particles. The volume average particle diameter of the dispersion 1 of fine particles was measured by SALD7000 to be 3.3 μm.

Production of Dispersion 2 of Colorant Particles 10 parts by mass of carbon black (Mogul L, available from Cabot Corporation) as a black pigment, 1 part by mass of sodium dodecyl benzenesulfonate (NEOPELEX G15, available from Kao Corporation), and 89 parts by mass of deionized water were mixed by a homogenizer. The obtained mixture solution was dispersed by a high-pressure homogenizer NANO3000 to obtain a dispersion 2 of colorant particles. The volume average particle diameter of the dispersion 2 was measured by SALD7000 to be 0.12 μm. The dispersion 2 had a shape particle size distribution with a standard deviation of 0.15.

Production of Dispersion 3 of Colorant Particles 2 parts by mass of 3-(4-diethylamino-2-hexyloxyphenyl)-3-(1-ethyl-2-methylindol-3-yl)-4-azaphtalide as a leuco dye, 4 parts by mass of 1,1-bis(4'-hydroxyphenyl)hexafluoropropane and 4 parts by mass of 1,1-bis(4'-hydroxyphenyl)n-decane as color developers, and 50 parts by mass of 4-benzyloxyphenylethyl caprylate as a decolorizing agent were uniformity dissolved by warming. 30 parts by mass of aromatic polyvalent isocyanate prepolymer and parts by mass of ethyl acetate as encapsulating agents were mixed in the obtained mixture. The resulting solution was dispersed in 300 parts by mass of 8% polyvinyl alcohol solution by emulsification and the mixture was stirred at 80° C. over about 1 hour. After then, 2.5 parts by mass of modified water-soluble aliphatic amine as a reactant was added, and the resulting mixture was stirred over 6 hours to obtain colorless capsule particles. The dispersion of capsule particles was put in a refrigerator (−30° C.) to develop color. Deionized water was added to obtain a 27% by weight dispersion 3 of colorant particles. The volume average particle diameter of the dispersion 3 of fine particles was measured by SALD7000 to be 0.45 μm.

Production of Dispersion 1 of Release Agent Particles 20 parts by mass of carnauba wax, 1 part by mass of dipotassium alkenyl sulfosuccinate (LATEMUL ASK, available from Kao Corporation), and 79 parts by mass of deionized water were mixed to obtain a dispersion solution. The dispersion solution was put into a rotor-stator homogenizer CLEAMIX 2.2S (manufactured by M Technique Co., Ltd.), and was heated to 100° C. with stirring at 1,000 rpm to obtain a dispersion 1 of release agent particles. The volume average particle diameter of the dispersion 1 was measured by SALD7000 to be 0.5 μm.

Production of Dispersion 2 of Release Agent Particles 20 parts by mass of carnauba wax, 1 part by mass of dipotassium alkenyl sulfosuccinate (LATEMUL ASK, available from Kao Corporation), and 79 parts by mass of deionized water were mixed to obtain a dispersion solution. The dispersion solution was put into a rotor-stator homogenizer CLEAMIX 2.2S (manufactured by M Technique Co., Ltd.), and was heated to 80° C. with stirring at 500 rpm to obtain a dispersion 2 of release agent particles. The volume average particle diameter of the dispersion 2 was measured by SALD7000 to be 4.5 μm.

Production of Dispersion 3 of Release Agent Particles 20 parts by mass of paraffin wax (HNP-3, available from NIPPON SEIRO CO., LTD.) with a melting point of 66° C., 1 part by mass of dipotassium alkenyl sulfosuccinate (LATEMUL ASK, available from Kao Corporation), and 79 parts by mass of deionized water were mixed to obtain a dispersion solution. The dispersion solution was put into a rotor-stator homogenizer CLEAMIX 2.2S (manufactured by M Technique Co., Ltd.), and was heated to 80° C. with stirring at 500 rpm to obtain a dispersion 3 of release agent particles. The volume average particle diameter of the dispersion 3 was measured by SALD7000 to be 0.5 μm.

EXAMPLE 1

42 parts by mass of dispersion 1 of colorant particles and 63 parts by mass of deionized water were mixed, 50 parts by mass of 30% ammonium sulfate solution was added to the mixture with stirring, and the mixture was kept for 1 hour. 14 parts by mass of dispersion 1 of release agent particles was added and the mixture was warmed to 30° C. to produce a dispersion solution of first aggregates having a volume average particle diameter of 6.2 μm.

300 parts by mass of dispersion 1 of resin particles with a solid concentration of 15% was gradually added to the dispersion solution over 10 hours to obtain a dispersion solution of aggregates of toner composition having a volume average particle diameter of 9.3 μm (CV value: 16.5) as a second aggregate dispersion solution. 5 parts by mass of polycarboxylic acid-based surfactant (POIZ520, available from Kao Corporation) as a surfactant was added to the dispersion solution of aggregates of toner composition, and the mixture was heated to 60° C. and allowed to stand to obtain a toner dispersion solution. The toner dispersion solution was filtered and washed with deionized water repeatedly until the conductance of the filtrate was 50 μS/cm. The filtered solid was dried by a vacuum dryer until the water content was 1.0% by weight or less to obtain dried toner particles. The state of surface of the toner particle was observed by an electron microscope. The toner particle has a good surface characteristic. The specific surface area was measured by a specific surface area measuring device to be 1.65 $cm^2/g$.

After the drying, 2 parts by mass of hydrophobic silica and 0.5 part by mass of titanium oxide as additives were attached to the surfaces of toner particles to obtain a toner of Example 1.

COMPARATIVE EXAMPLE 1

150 parts by mass of dispersion 1 of resin particles (solid concentration: 30%), 42 parts by mass of dispersion 1 of colorant particles, 14 parts by mass of dispersion 1 of release agent particles, and 80 parts by mass of deionized water were mixed. To the mixture, 40 parts by mass of 30% ammonium sulfate solution was added with stirring, and the mixture was kept for 1 hours. The mixture was warmed to 45° C. to obtain a dispersion solution of aggregates of toner composition with a volume average particle diameter of 9.5 μm (CV value: 17.5).

5 parts by mass of polycarboxylic acid-based surfactant (POIZ520, available from Kao Corporation) as a surfactant was added to the dispersion solution of aggregates of toner composition, and the mixture was heated to 60° C. and allowed to stand to obtain a toner dispersion solution. The toner dispersion solution was filtered and washed with deionized water several times until the conductance of the filtrate was 50 μS/cm. The filtered solid was dried by a vacuum dryer until the water content was 1.0% by weight or less to obtain dried toner particles. The state of surface of the toner particle was observed by an electron microscope. Capsule particles with about 2 μm were exposed on the surface. The specific surface area was measured by a specific surface area measuring device to be 3.45 $cm^2/g$.

After the drying, 2 parts by mass of hydrophobic silica and 0.5 part by mass of titanium oxide as additives were attached to the surfaces of toner particles to obtain a toner of Comparative Example 1.

EXAMPLE 2

15 parts by mass of dispersion 2 of colorant particles and 63 parts by mass of deionized water were mixed, 50 parts by mass of 30% ammonium sulfate solution was added with stirring, and the mixture was kept for 1 hour. 14 parts by mass of dispersion 1 of release agent particles was added and the mixture was warmed to 30° C. to produce a dispersion solution of first aggregates having a volume average particle diameter of 3.2 μm.

300 parts by mass of dispersion 1 of resin particles with a solid concentration of 15% was gradually added to the dispersion solution over 10 hours to obtain a dispersion solution of aggregates of toner composition having a volume average particle diameter of 5.6 μm (CV value: 18.3) as a second aggregate dispersion solution. 5 parts by mass of polycarboxylic acid-based surfactant (POIZ520, available from Kao Corporation) as a surfactant was added to the dispersion solution of aggregates of toner composition, and the mixture was heated to 60° C. and allowed to stand to obtain a toner dispersion solution. The toner dispersion solution was filtered and washed with deionized water several times until the conductance of the filtrate was 50 μS/cm. The filtered solid was dried by a vacuum dryer until the water content was 1.0% by weight or less to obtain dried toner particles. The state of surface of the toner particle was observed by an electron microscope. The toner particle has a good surface characteristic. The specific surface area was measured by a specific surface area measuring device to be 1.85 $cm^2/g$.

After the drying, 2 parts by mass of hydrophobic silica and 0.5 part by mass of titanium oxide as additives were attached to the surfaces of toner particles to obtain a toner of Example 2.

COMPARATIVE EXAMPLE 2

150 parts by mass of dispersion 1 of resin particles (solid concentration: 30%), 15 parts by mass of dispersion 2 of colorant particles, 14 parts by mass of dispersion 1 of release agent particles, and 80 parts by mass of deionized water were mixed, 40 parts by mass of 30% ammonium sulfate solution was added with stirring, and the mixture was kept for 1 hour. The mixture was warmed to 45° C. to produce a dispersion solution of aggregates of toner composition having a volume average particle diameter of 5.5 μm (CV value: 18.5).

5 parts by mass of polycarboxylic acid-based surfactant (POIZ520, available from Kao Corporation) as a surfactant was added to the dispersion solution of aggregates of toner composition, and the mixture was heated to 60° C. and allowed to stand to obtain a toner dispersion solution. The toner dispersion solution was filtered and washed with deionized water several times until the conductance of the filtrate was 50 μS/cm. The filtered solid was dried by a vacuum dryer until the water content was 1.0% by weight or less to obtain dried toner particles. When the state of surface of the toner particle was observed by an electron microscope, the surface characteristic was good. When the section was observed by a transmission electron microscope, a black pigment locally existed near the toner surface. The specific surface area was measured by a specific surface area measuring device to be 1.85 $cm^2/g$.

After the drying, 2 parts by mass of hydrophobic silica and 0.5 part by mass of titanium oxide as additives were attached to the surfaces of toner particles to obtain a toner of Comparative Example 2.

EXAMPLE 3

Dried toner particles with a specific surface area of 1.75 $cm^2/g$ were obtained in the same manner as in Example 1 except that 40 parts by mass of dispersion 1 of release agent particles, 72 parts by mass of deionized water, and 265 parts by mass of dispersion 1 of resin particles with a solid concentration of 15% were used. 2 parts by mass of hydrophobic silica and 0.5 part by mass of titanium oxide were attached to the surfaces of the dried toner particles to obtain a toner of Example 3.

COMPARATIVE EXAMPLE 3

Dried toner particles with a specific surface area of 3.56 $cm^2/g$ were obtained in the same manner as in Example 1 except that 40 parts by mass of dispersion 1 of release agent particles, 71.5 parts by mass of deionized water, and 132.5 parts by mass of dispersion 1 of resin particles were used. 2 parts by mass of hydrophobic silica and 0.5 part by mass of titanium oxide were attached to the surfaces of the dried toner particles to obtain a toner of Comparative Example 3.

EXAMPLE 4

Dried toner particles with a specific surface area of 1.89 $cm^2/g$ were obtained in the same manner as in Example 1 except that 60 parts by mass of dispersion 1 of release agent particles, 79 parts by mass of deionized water, and 238 parts by mass of dispersion 1 of resin particles with a solid concentration of 15% were used. 2 parts by mass of hydrophobic silica and 0.5 part by mass of titanium oxide were attached to the surfaces of the dried toner particles to obtain a toner of Example 4.

COMPARATIVE EXAMPLE 4

Dried toner particles with a specific surface area of 7.54 $cm^2/g$ were obtained in the same manner as in Example 1 except that 60 parts by mass of dispersion 1 of release agent particles, 65 parts by mass of deionized water, and 119 parts by mass of dispersion 1 of resin particles were used. 2 parts by mass of hydrophobic silica and 0.5 part by mass of titanium oxide were attached to the surfaces of the dried toner particles to obtain a toner of Comparative Example 4.

COMPARATIVE EXAMPLE 5

Dried toner particles with a specific surface area of 4.5 $cm^2/g$ were obtained in the same manner as in Example 1 except that the dispersion 2 of release agent particles was used instead of the dispersion 1 of release agent particles. 2 parts by mass of hydrophobic silica and 0.5 part by mass of titanium oxide were attached to the surfaces of the dried toner particles to obtain a toner of Comparative Example 5.

COMPARATIVE EXAMPLE 6

Dried toner particles with a specific surface area of 1.35 $cm^2/g$ were obtained in the same manner as in Example 1 except that the dispersion 3 of colorant particles was used instead of the dispersion 1 of colorant particles. 2 parts by mass of hydrophobic silica and 0.5 part by mass of titanium oxide were attached to the surfaces of the dried toner particles to obtain a toner of Comparative Example 6.

COMPARATIVE EXAMPLE 7

Dried toner particles with a specific surface area of 3.5 $cm^2/g$ were obtained in the same manner as in Comparative Example 1 except that the dispersion 3 of colorant particles were used instead of the dispersion 1 of colorant particles. 2 parts by mass of hydrophobic silica and 0.5 part by mass of titanium oxide were attached to the surfaces of the dried toner particles to obtain a toner of Comparative Example 7.

EXAMPLE 5

Dried toner particles with a specific surface area of 1.35 $cm^2/g$ were obtained in the same manner as in Example 1 except that the dispersion 3 of release agent particles was used instead of the dispersion 1 of release agent particles. 2 parts by mass of hydrophobic silica and 0.5 part by mass of titanium oxide were attached to the surfaces of the dried toner particles to obtain a toner of Example 5.

EXAMPLE 6

Dried toner particles with a specific surface area of 1.55 $cm^2/g$ were obtained in the same manner as in Example 3 except that the dispersion 3 of release agent particles was used instead of the dispersion 1 of release agent particles. 2 parts by mass of hydrophobic silica and 0.5 part by mass of titanium oxide were attached to the surfaces of the dried toner particles to obtain a toner of Example 6.

EXAMPLE 7

Dried toner particles with a specific surface area of 1.75 $cm^2/g$ were obtained in the same manner as in Example 4 except that the dispersion 3 of release agent particles was used instead of the dispersion 1 of release agent particles. 2 parts by mass of hydrophobic silica and 0.5 part by mass of titanium oxide were attached to the surfaces of the dried toner particles to obtain a toner of Example 7.

As shown in FIG. 2, the toners of Examples have excellent charge stability and storage stability, and the toners of Comparative Examples 1 to 4 and 7 which had been produced by the ordinary aggregation method have inferior charge stability and storage stability.

In the toners of Comparative Examples 5 and 6, the volume average particle diameter of release agent particles is larger than that of colorant particles, and charge stability and storage stability are inferior to the toners of Examples.

The low-temperature fixities of the toners of Examples 1, 3, and 4 are improved due to increase in a release agent component. The low-temperature fixities of the toners of Comparative Examples 1, 3, and 4 produced by the ordinary aggregation method deteriorate due to increase in a release agent component.

From results of the toners of Examples 5 to 7, the low-temperature fixities are better than that of toner using carnauba wax due to the use of paraffin wax in a polyester resin.

While certain embodiments have been described, these embodiments have been presented by way of example only, and are not intended to limit the scope of invention. Indeed, the novel toner and method described herein may be embodied in a variety of other forms; furthermore, various omissions, substitutions and changes in the form of the toner and method described herein may be made without departing from the spirit of the inventions. The accompanying claims and their equivalents are intended to cover such forms or modifications as would fall within the scope and spirit of the inventions.

According to the technique described in this specification, a technique of improving charge stability and storage stability can be imparted to a toner as described above.

What is claimed is:

1. A method for producing an electrophotographic toner comprising: mixing a dispersion of colorant particles and a dispersion of release agent particles to form a dispersion of the colorant particles and the release agent particles;

aggregating the colorant particles and the release agent particles to produce a dispersion of first aggregates; mixing a dispersion of resin particles containing a polyester binder resin into the dispersion containing of first aggregates and aggregating the first aggregates and the resin to coat the first aggregates with the resin particles, thereby producing second aggregates.

2. The method for producing an electrophotographic toner according to claim 1 , wherein the release agent contained in the release agent particles is a hydrocarbon wax.

3. The method for producing an electrophotographic toner according to claim 1, wherein the colorant particles contain at least a color developable compound and a color developer and have a capsule structure coated with an outer shell.

4. The method for producing an electrophotographic toner according to claim 1, wherein the volume average particle diameter of the release agent particles is smaller than that of the colorant particles, and the volume average particle diameter of the resin particles is smaller than that of the release agent particles.

5. The method for producing an electrophotographic toner according to claim 4, wherein the colorant particles in the dispersion of the colorant particles has a volume average particle diameter of 0.5 μm to 7 μm.

* * * * *